United States Patent [19]

Ray et al.

[11] Patent Number: 4,924,453

[45] Date of Patent: May 8, 1990

[54] WATCH HAVING A GLASS RETAINING STRAP

[75] Inventors: Claude Ray, Canton of Neuchatel; Michiel Groothuis, Canton of Berne, both of Switzerland

[73] Assignee: Le Phare-Jean D'Eve S.A., Switzerland

[21] Appl. No.: 307,067

[22] Filed: Feb. 6, 1989

[30] Foreign Application Priority Data

Feb. 9, 1988 [CH] Switzerland ..... 457/88

[51] Int. Cl.[5] ..... G04B 37/00

[52] U.S. Cl. ..... 368/294; 368/281; 368/282

[58] Field of Search ..... 368/294–296

[56] References Cited

U.S. PATENT DOCUMENTS

| | | | |
|---|---|---|---|
| Re. 32,617 | 1/1988 | Gogniat | 368/294 |
| 2,155,842 | 4/1939 | Ruger | 368/294 |
| 2,344,422 | 3/1944 | Sickinger | 368/294 |
| 4,390,288 | 6/1983 | Arnoux | 368/294 |
| 4,464,063 | 8/1984 | Gogniat | 368/281 |
| 4,493,562 | 1/1985 | Gagnebin | 368/294 |
| 4,637,734 | 1/1987 | Gogniat | 368/296 |
| 4,727,525 | 2/1988 | Gogniat et al. | 368/294 |

FOREIGN PATENT DOCUMENTS

| | | | |
|---|---|---|---|
| 046622 | 8/1981 | European Pat. Off. . | |
| 080973 | 11/1982 | European Pat. Off. . | |
| 835486 | 9/1937 | France . | |
| 647121 | 1/1985 | Sweden . | |
| 221352 | 5/1942 | Switzerland | 368/296 |
| 282142 | 4/1952 | Switzerland | 368/296 |
| 106357 | 6/1917 | United Kingdom . | |

*Primary Examiner*—Bernard Roskoski

*Attorney, Agent, or Firm*—Silverman, Cass & Singer, Ltd.

[57] ABSTRACT

A watch casing has a back and a body or middle part made in one piece, and a glass engaged in the middle part. A strap is provided with an annular central portion bearing on the glass and with diametral arms secured to hinge lugs of the casing serving for the attachment of the bracelet. Thus, the glass is retained in place even when it is only engaged frictionally in a sealing gasket located in the casing body. The removal of the glass can be effected easily by engaging a blade into a lip of the casing body and into an annular groove provided for this purpose in the lateral face of the glass.

5 Claims, 1 Drawing Sheet

WATCH HAVING A GLASS RETAINING STRAP

BACKGROUND OF THE INVENTION (a) Field of the Invention

The present invention relates to a watch casing of the so-called "one piece" type, that is to say of the type in which the back of the casing and its body or middle part are made in one piece.

(b) Description of the Prior Art

Such watch casings, which are known per se, possess the drawback that, if the glass is snap fitted on the casing body or back-bezel, it is not easy to remove it since it is not possible to act behind the glass for exerting thereon a pressure to extract it.

In the case of a domed glass, of synthetic glass and which is resiliently deformable, it is possible to use apparatus which surrounds the glass and deforms it so as to permit it to be extracted. Such a solution is however not possible with glasses made in extra hard material, such as hardened mineral glass or sapphire, which are practically undeformable.

SUMMARY OF THE INVENTION

The object of the present invention is to provide means for securing a glass of a watch casing the back and the body of which are made in one piece which allows the glass easily to be detached while providing safe attachment of the glass.

To this end, a watch casing according to the invention has the glass thereof frictionally engaged into the middle part of the casing and is retained by a diametral strap which bears thereon and which is on the other hand secured, by its ends, to the back/middle part of the casing.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENT

Figure 1:
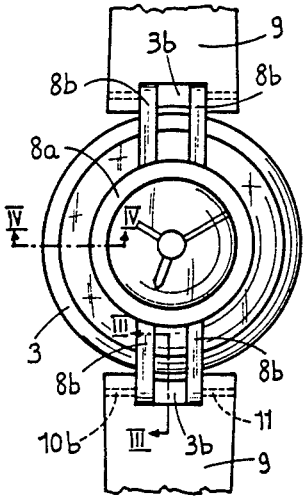
FIG. 1 is a plan view of a wrist-watch, the casing of which represents a preferred embodiment of the invention.
Figure 2:
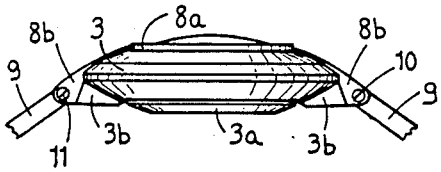
FIG. 2 is a side view thereof.
Figure 3:
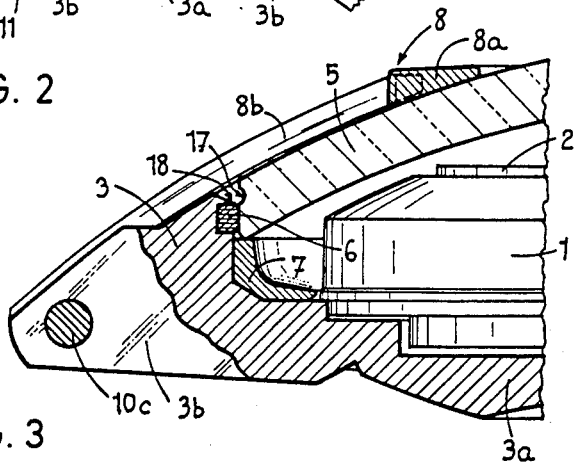
FIG. 3 is a partial sectional view on the line III—III of FIG. 1 to a larger scale.

The clockwork of the illustrated wristwatch, designated by reference 1 and provided with its dial designated by reference 2, is located in a waterproof casing of the so-called "one piece" type, that is to say in which the body or middle part of which, designated by reference 3, is made of one piece with the back, designated by reference 3*a*. The clockwork is secured to this back/body 3-3*a* by screws 4 threaded therein.

The glass of the casing, preferably made of an extra hard material such as hardened mineral glass or sapphire, designated by reference 5, is engaged with light friction in the casing body of the middle part 3 with the interposition of a sealing gasket 6 made of flexible and compressible material. The glass 5 bears on a spacer ring 7 surrounding the clockwork 1.

The glass 5 is retained in place in the casing body 3 and is even pressed axially against the front axial face of the ring 7, by a diametral tensioning strap 8 comprising an annular part 8*a* bearing on the glass and two pairs of arms 8*b* which are diametrically opposed. The ends of the arm pairs 8*b* engage on both sides of each of two hinge lugs presented by the casing body or middle part 3, and which serve for the attachment of a bracelet designated by reference 9.

The connection between the two ends of the arms 8*b* and each of the hinge lugs 3*b* is obtained owing to a stepped small rod 10 the inner end portion of which, which is the thinnest and designated by reference 10*a*, is threaded and receives, screwed thereon, a threaded sleeve 11 the diameter of which corresponds to the portion of largest diameter, designated by reference 10*b*, of the small rod 10. The diameter of the part 10*b* of the small rod 10 and of the sleeve 11 corresponds to the diameter of the bores, designated by reference 12, provided in the arms 8*b* of the diametral strap 8 retaining the glass 5 in place, while the central part of the small rod 10, designated by reference 10*c*, has a diameter which corresponds to that of a through bore designated by reference 13 in each of the hinge lugs 3*b*. The parts 10*b* and 10*c* of the small rod 10 are interconnected through a chamfer 14, while the front end of the sleeve 11 is provided with a chamfer 15.

The arrangement is such that, when the glass 5 is in place in the middle part 3 with the diametral strap for retaining it applied thereon, it is necessary to exert a slight force on the ends of the arms 8*b* to bring the bores 12 of these arms opposite the respective bores 13 of the hinge lugs 3*b*. The small rods 10 are then fitted and the sleeves 11 respectively screwed on to them. The chamfers 14 and 15, co-operating with conical entrances 16 of the bores 12 provide guidance to assist the insertion of the small rods 10 and sleeves 11 if the bores 12 are not perfectly aligned with the bores 13. The small rods exert then a pre-tensioning force on the diametral strap 8 which, hence, exerts a resilient axial force on the glass 5, applying it axially against the ring 7. In this way, the glass 5 is firmly retained in place without any risk, even should its friction on the sealing gasket 6 be insignificant, of untimely separation from the casing body.

The parts of the small rod 10 and of the sleeve 11 which extend beyond the arms 8*b* of the strap once the mounting is effected constitute securing means for the bracelet 9.

The extraction of the glass, once the diametral securing strap 8 is detached, is effected easily, since the casing body has, opposite one of its two hinge lugs 3*b*, a lip or file-mark 17 which permits the introduction of a blade in an annular groove 18 presented for this purpose by the glass 5.

Figure 4:
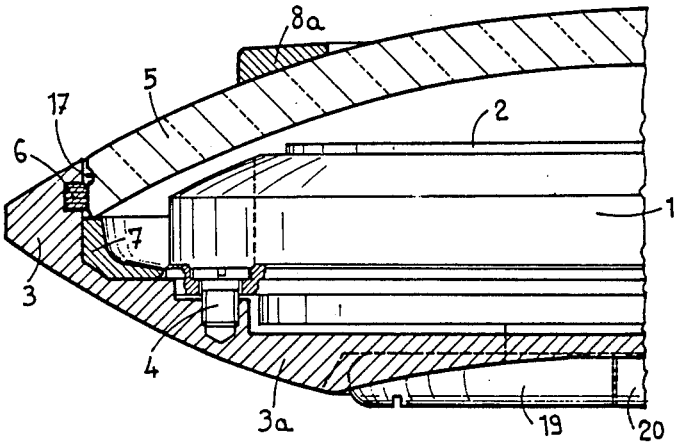
FIG. 4 is a sectional view on the line IV—IV of FIG. 1 to the scale of FIG. 3.
Figure 5:
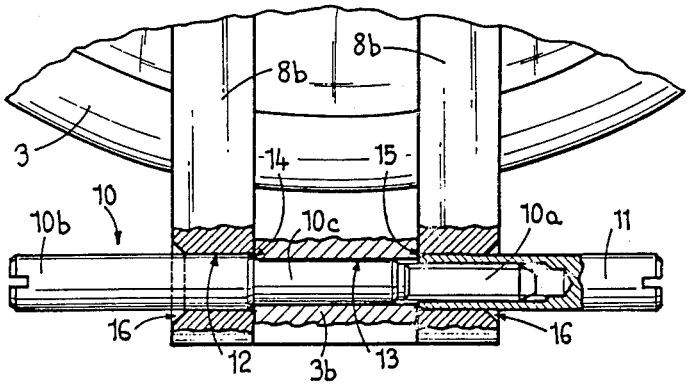
FIG. 5 is a plan view of a detail, in partial section, to the scale of FIGS. 3 and 4.

It is to be noted that the resetting, even the winding of the main spring if the clockwork is mechanical, is effected by means of a half circular stirrup 19 (FIG. 4), situated outside the back 3*a*, articulated on a circular member 20 rotatably mounted on the back. This stirrup can occupy two positions, one being an operative position, in which it is perpendicular to the plane of the casing and thus can be gripped for the purpose of driving of the member 20, and the other one being a rest position, illustrated in the drawings, in which it is recessed into the plane of the casing.

As a modification, the two hinge lugs 3*b* for attachment of the bracelet and of the diametral strap may be replaced by two bows. In this case, the arms 8*b* will be engaged between the two bows, the bracelet itself being engaged between the said arms.

Each pair of arms 8*b* may be replaced by a sole arm terminating in a fork-shaped portion the two branches of which will in each case engage the corresponding hinge lug of the casing or between the corresponding bows thereof.

As a further modification, the diametral strap may be provided, for an aesthetic purpose, with two supplementary radial arms extending perpendicularly to its main part; these arms could also be secured, by their ends, to the body of the casing.

The attachment of the strap to the casing body can be different from that which has been described and illustrated and, especially, could be independent from the attachment means of the bracelet.

Finally, the annular central part 8*a* of the strap may carry the hours division.

We claim:

1. A watch casing comprising a back and a middle part made in one piece, in which a glass is frictionally engaged into the middle part and is retained by a diametral strap which bears thereon, said diametral strap being secured, by its ends, to said back/middle part of the casing and including an annular central part bearing on the glass and two radial arms, situated on a common diameter, the free ends of said radial arms being secured to said back/middle part.

2. A watch casing as claimed in claim 1, in which the ends of the said diametral strap are secured to attachment members for a bracelet, which attachment members are provided on the back/middle part.

3. A watch casing as claimed in claim 2, in which the ends of the diametral strap are respectively secured to the said attachment members for the bracelet by means of small rods each made of two aligned parts, one of which has the form of an internally threaded sleeve into which is screwed a threaded inner end of the other of said two parts.

4. A watch casing as claimed in claim 2, in which the said attachment means for the bracelet are constituted by hinge lugs, and in which the diametral strap is provided at each of its ends with a fork-shaped part the branches of which engage on both sides of each of the said hinge lugs and are each provided with a bore traversed by a small rod serving at the same time for the attachment of said strap and for the attachment of the bracelet.

5. A watch casing as claimed in claim 2, in which said attachment members for the bracelet are constituted by bows, and in which the diametral strap is provided at each of its ends with a fork-shaped part the branches of which are adjacent said bows and are each provided with a bore traversed by a small rod serving at the same time for the attachment of said strap and for the attachment of the bracelet.

* * * * *